US005447383A

United States Patent [19]

Hirono et al.

[11] Patent Number: 5,447,383

[45] Date of Patent: Sep. 5, 1995

[54] TAPE PRINTING APPARATUS HAVING MANUAL TAPE CUTTING DEVICE WITH SUSPENSION OF PRINTING

[75] Inventors: Kazuhisa Hirono; Akihiko Niwa, both of Nagoya; Chitoshi Ito, Kasugai; Mayumi Nishio, Nagoya, all of Japan

[73] Assignee: Brother Kogyo Kabushiki Kaisha, Nagoya, Japan

[21] Appl. No.: 333,335

[22] Filed: Nov. 2, 1994

[30] Foreign Application Priority Data

Nov. 10, 1993 [JP] Japan ..... 5-305810

[51] Int. Cl.[6] ..... B41J 11/66

[52] U.S. Cl. ..... 400/621; 400/615.2; 358/304

[58] Field of Search ..... 400/615.2, 621; 358/304; 346/24

[56] References Cited

U.S. PATENT DOCUMENTS

| | | | |
|---|---|---|---|
| 4,984,916 | 1/1991 | Sekine et al. | 400/621 |
| 5,099,290 | 3/1992 | Yokota | 400/621 |
| 5,131,772 | 7/1992 | Yamaguchi | 400/621 |
| 5,209,151 | 5/1993 | Takagi et al. | 400/621 |
| 5,222,818 | 6/1993 | Akiyama et al. | 400/621 |
| 5,224,786 | 7/1993 | Takagi et al. | 400/621 |
| 5,315,398 | 5/1994 | Otsuki | 346/24 |

FOREIGN PATENT DOCUMENTS

| | | | |
|---|---|---|---|
| 1-85050 | 6/1989 | Japan | 400/615.2 |
| 2-106555 | 4/1990 | Japan | 400/615.2 |

*Primary Examiner*—David A. Wiecking
*Assistant Examiner*—Steven S. Kelley
*Attorney, Agent, or Firm*—Oliff & Berridge

[57] ABSTRACT

A tape printing apparatus having a detection member which detects movement of a tape cutter to its tape cutting direction. A control system is provided for stopping tape feeding and tape printing operation when the detection member detects the movement of the tape cutter for preventing the print tape from being entangled with an internal mechanical component. Printing operation for one train of dots read from a print buffer is performed when a print key is operated and the count value of a tape feed counter is incremented by 1 dot. Such steps are repeatedly performed if no cutting operation is made by means of a cutting control button and If tape feed count value is not coincident with cut position data, and if a sequence of printing processes have not yet been completed. On the other hand, if the cutting control button is operated while a printing operation is being performed, the printing operation and tape feeding operation are stopped. If the cutting operation is completed, tape is automatically fed by a predetermined length.

19 Claims, 15 Drawing Sheets

TAPE PRINTING APPARATUS HAVING MANUAL TAPE CUTTING DEVICE WITH SUSPENSION OF PRINTING

BACKGROUND OF THE INVENTION

The present invention relates to a tape printing apparatus having a manual tape cutting device.

One example of a conventional tape printing apparatus is described in a Japanese Utility Model Application Kokai No. Hei 1-85050. The conventional device includes a keyboard, a display, a printing mechanism having a thermal head, and a tape feed mechanism. A tape cassette accommodating therein an elongated printing medium such as a tape having a width of 12 mm or 18 mm is installed in the printing apparatus. Intended characters and symbols are input through the keyboard, and the printing mechanism performs label-printing on the tape with characters and symbols input through the keyboard. The tape printing apparatus is further provided with various editing functions.

Within the tape cassette, a tape spool, a ribbon supply spool, a ribbon takeup spool, and another supply spool are rotatably provided. A laminate film tape as the printing medium is wound around the tape spool, a print ribbon is wound around the ribbon supply spool, and a double-coated tape to be stuck to the laminate film tape is wound around the other supply spool. Further, in the tape cassette, a platen roller and various rollers are rotatably supported. The platen roller is adapted for pressing the laminate film tape and the print ribbon against the thermal head.

When electrical current is supplied to the thermal head while the tape feed mechanism is driven to rotate the plurality of spools, characters and symbols formed of trains of dots are printed on the laminate film tape, and then, the double-coated tape is attached to the laminate film tape to thereby form a print tape, and the print tape is fed to the outside of the tape printing apparatus.

Also proposed is a tape printing apparatus with a simplified manual cutting device installed at a position adjacent an outlet of the printed tape, the cutting device facilitating cutting of the printed tape at a desired position. The manual cutting device has a simple mechanism adapted to cut the printed tape easily and neatly with a pair of scissors including a movable blade and a stationary blade by depressing a cutting button.

In the tape printing apparatus provided with the above described simplified manual cutting device, the print tape can be cut at any timing regardless of during the printing operation where the tape feed mechanism and the thermal head are controlledly driven. Accordingly, when a cutting operation is made by mistake while a printing operation is being performed, the tape printed and fed forward is caught by the scissors of the manual cutting device, and hence, the tape cannot be fed out of the tape printing apparatus. Thus, the tape cannot be fed to the outside, but may be entangled with a driving system in the vicinity of the outlet of the tape cassette and jammed, to render the tape cassette inoperative.

Further, even if the print tape does not get entangled with the driving system in the vicinity of the outlet of the tape cassette as a result of tape cutting while it is being printed, previously printed document remains on the print tape at a tape region bridging between the printing position and the cut position. With this state, if subsequent printing operation is performed, the newly document may contain the previously printed document. That is, since a given distance is provided between the printing position and cutting position positioned downstream thereof, tape cutting must be carried out after the tape is fed by the given distance, otherwise the printed document is inadvertently cut, or a newly printed document may contain the previous cut document after cutting. Therefore, the thus printed tape may not be usable and may be wasted. In order to avoid this problem, the part of the document remaining in the tape cassette and in the tape printer must be intentionally discharged by feeding the tape before the subsequent printing operation. However, such work may be troublesome, and may still be wasteful if excessive length of the tape is discharged out of the tape outlet.

SUMMARY OF THE INVENTION

It is therefore an object of the present invention to provide an improved tape printing apparatus having a manual cutting device capable of immediately stopping its printing operation when an elongated printing medium such as a tape is cut by the manual cutting device during printing operation to the tape.

Another object of the present invention is to provide such apparatus capable of preventing the print tape from being entangled with a tape cassette when the manual cutting device is operated.

These and other objects of the present invention will be attained by providing a tape printing apparatus for printing an image on a tape medium, the apparatus comprising printing means, manual cutting device, cutting operation detection means, and means for stopping printing operation. The printing means has a tape feed mechanism for feeding the tape medium, and a printing head for printing the image on the tape medium. The manual cutting device has a cutting mechanism for cutting the tape medium. The cutting operation detection means is adapted for detecting a start of the cutting operation of the manual cutting device. A cutting operation start signal is generated upon detection of the start of the cutting operation. The stopping means is adapted for stopping printing operation to the tape medium in response to the cutting operation start signal.

In another aspect of the invention, there is provided a tape printing apparatus for printing an image in a tape medium accommodated in a tape cassette the apparatus comprising a body frame, printing means, control means, a manual cutting device, cutting operation detection means, and means for stopping printing operation. In the body frame, the tape cassette is installable. The printing means has a tape feed mechanism for feeding the tape medium in a tape feeding direction, and a printing head for printing characters and symbols on the tape medium fed by the tape feed mechanism. The control means is adapted for controlling the tape feed mechanism and the printing head of the printing means. The manual cutting device is disposed downstream of the printing head in the tape feeding direction. The manual cutting device has a cutting mechanism. The cutting operation detection means is adapted for detecting a start of the cutting operation of the manual cutting device. A cutting operation start signal is generated upon detection of the start of the cutting operation. The means for stopping printing operation is adapted for stopping a printing operation to the tape medium. The stopping means generates in response to the cutting operation start signal, a print stopping signal which is transmittable to the control means for rendering the printing means inoperative.

In still another aspect of the invention, there is provided a method for printing an image on a tape medium with using a tape printing apparatus comprising printing means having a tape feed mechanism for feeding the tape medium and a printing head for printing the image on the tape medium, and a manual cutting device for cutting the tape medium, the method comprising the steps of detecting operation of the manual cutting device, and stopping the printing operation of the printing means in response to the detection.

With this arrangement, printing operation and tape feed operation are immediately stopped when the tape is trapped by the manual cutting device for cutting the tape while the tape is being printed. Therefore, even if the tape is caught in the manual cutting device, the tape is prevented from getting entangled with a driving system in the vicinity of an outlet of the tape cassette, and thus, the tape cassette does not involve in any trouble.

The cutting operation detection means can further comprises means for detecting an end phase of the cutting operation. The cutting operation end signal is generated upon detection of the end of the cutting operation. The tape printer further includes means for starting operation of the tape feed mechanism so as to feed the tape medium by a predetermined length. The starting means generates, in response to the cutting operation end signal, a tape feed start signal which is transmittable to the control means for rendering the tape feed mechanism operative.

With this arrangement, the starting means causes the control means to feed the predetermined length of the tape. Therefore, by cutting the tape after the predetermined amount of the tape feeding, there remains no portion of previously printed document in the tape at the portion between the printing head and the manual cutting device. Accordingly, the subsequent printing operation can be started with exclusively new document.

DETAILED DESCRIPTION OF THE PREFERRED EMBODIMENTS

A tape printing apparatus according to one embodiment of the invention will be described below with reference to the accompanying drawings.

Figure 1:
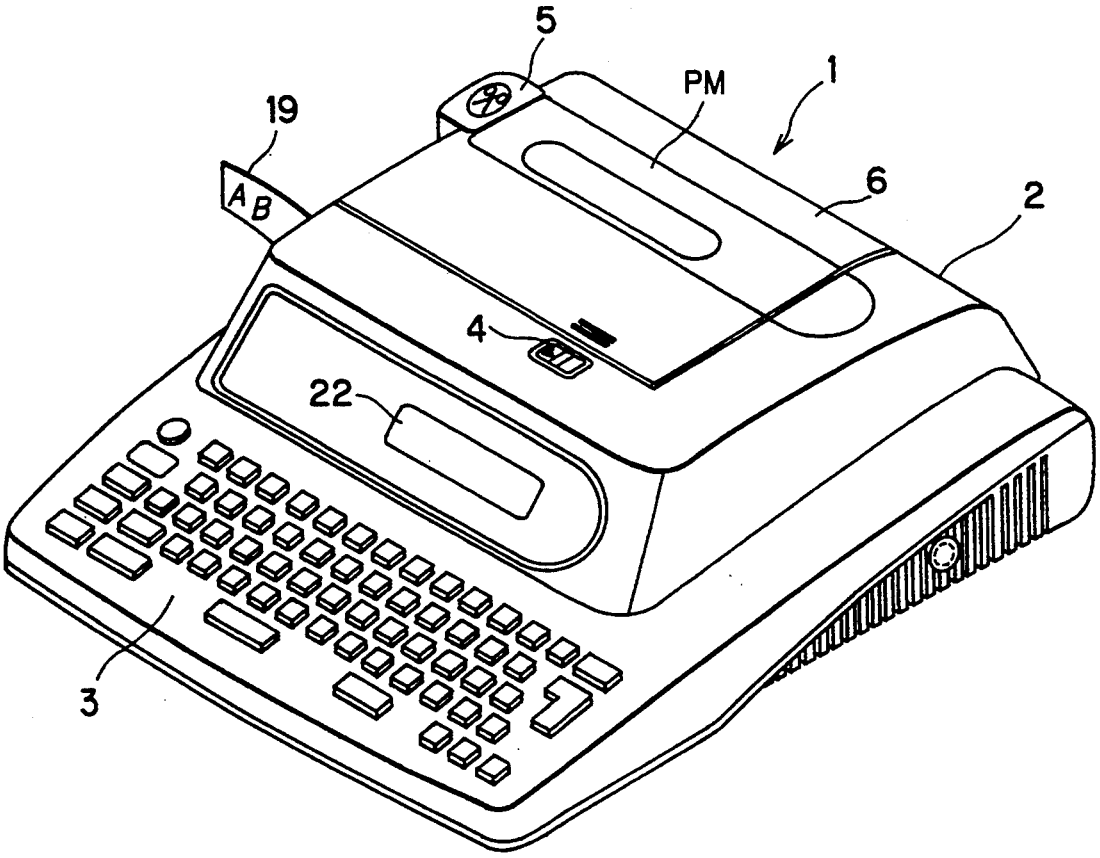
FIG. 1 is a perspective view showing a tape printing apparatus.

As shown in FIG. 1, a tape printing apparatus 1 includes a body frame 2 and a keyboard 3 disposed in front of the body frame. A printing mechanism PM is provided within the body frame 2 and at the rear of the keyboard 3. A liquid crystal display 22 capable of displaying one line of characters and symbols is disposed just behind the keyboard 3. A cover frame 6 is provided to cover a tape cassette CS when loaded in the printing mechanism PM, and a release button 4 is provided for opening the cover frame 6 when the tape cassette CS to be loaded in the printing mechanism PM, is put in or removed. Further, a cutting operation button 5 serving as a cutting control member is provided laterally beside the cover 6 for manually cutting a print tape 19.

On the keyboard 3, there are provided character keys for inputting alphabetic characters, numeric characters, and symbols, a space key, a return key, cursor-move-left key, cursor-move-right key, cursor-move-up-key, cursor-move-down key, a size setting key for setting the size of the characters printed, a mode switch key for switching from a document inputting mode to a print parameter display mode and vice versa, a print key for commanding printing, and a power key for turning power on/off. Since the display 22 is adapted for displaying only one line, only the cursor-move-left key and cursor-move-right key are operative during document input operation through the keyboard 3.

The printing mechanism PM will be briefly described with reference to FIG. 1. A tape cassette CS having a rectangular shape is detachably loaded in the printing mechanism PM. Within the tape cassette CS, there are rotatably provided a tape spool 8 around which a laminate film tape 7 is wound, a ribbon supply spool 10 around which a print ribbon 9 is wound, a takeup spool 11 for taking up the print ribbon 9, a supply spool 13 around which a double coated tape 12 having a width the same as that of the laminate film 7 is wound with its peeling paper on the outside, and a press roller 14 for causing the double-coated tape 12 to adhere to the laminate film 7.

A thermal head or a printing head 15 upstands in a position where the laminate film tape 7 and the print ribbon 9 overlap with each other. On the thermal head 15, there is provided a group of heat generating elements arrayed in a vertical direction, the group being formed of a train of 128 heat generating elements. A support member 18 is pivotally mounted for angular rotation on the body frame 2, and a platen roller 16 and a feed roller 17 are rotatably supported on the support member 18. The platen roller 16 is adapted for pressing the laminate film tape 7 and the print ribbon 9 against the thermal head 15, and the feed roller 17 is adapted for pressing the laminate film tape 7 and the double coated tape 12 against the press roller 14 to thereby form the print tape 19.

Figure 4:
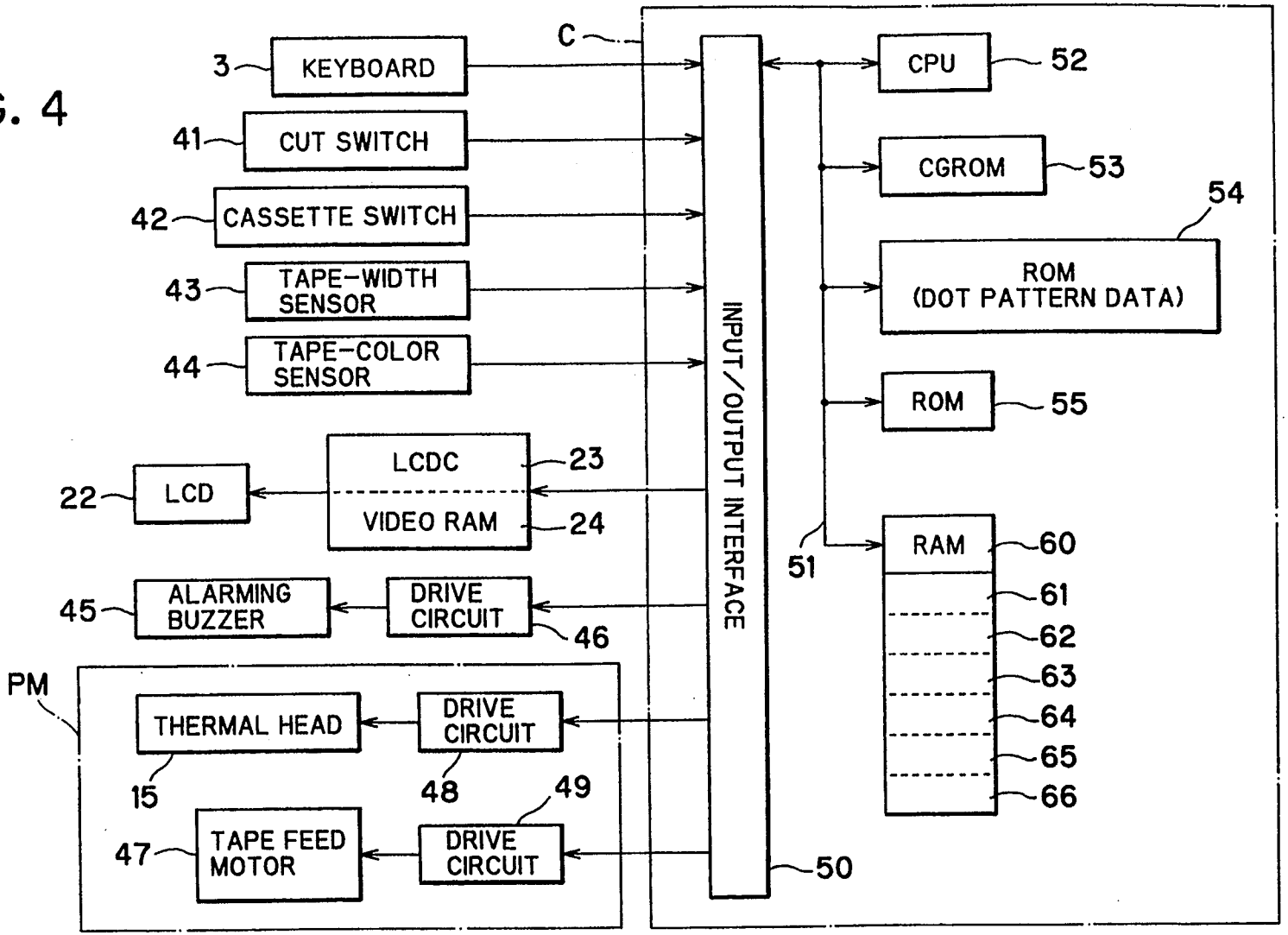
FIG. 4 is a block diagram showing a control system of the tape printing apparatus.
Figure 5:
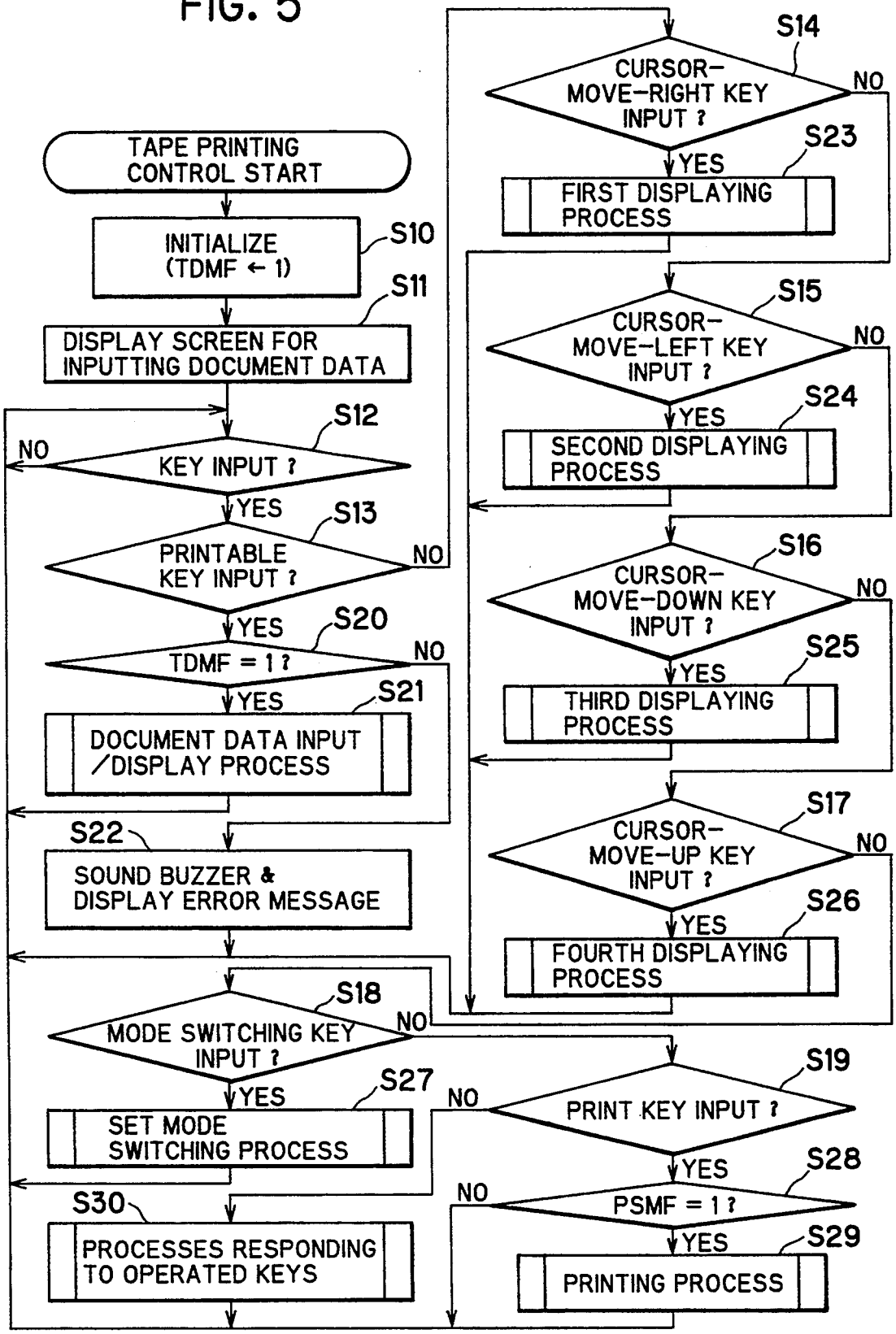
FIG. 5 is a flowchart showing a routine of tape printing control.
Figure 6:
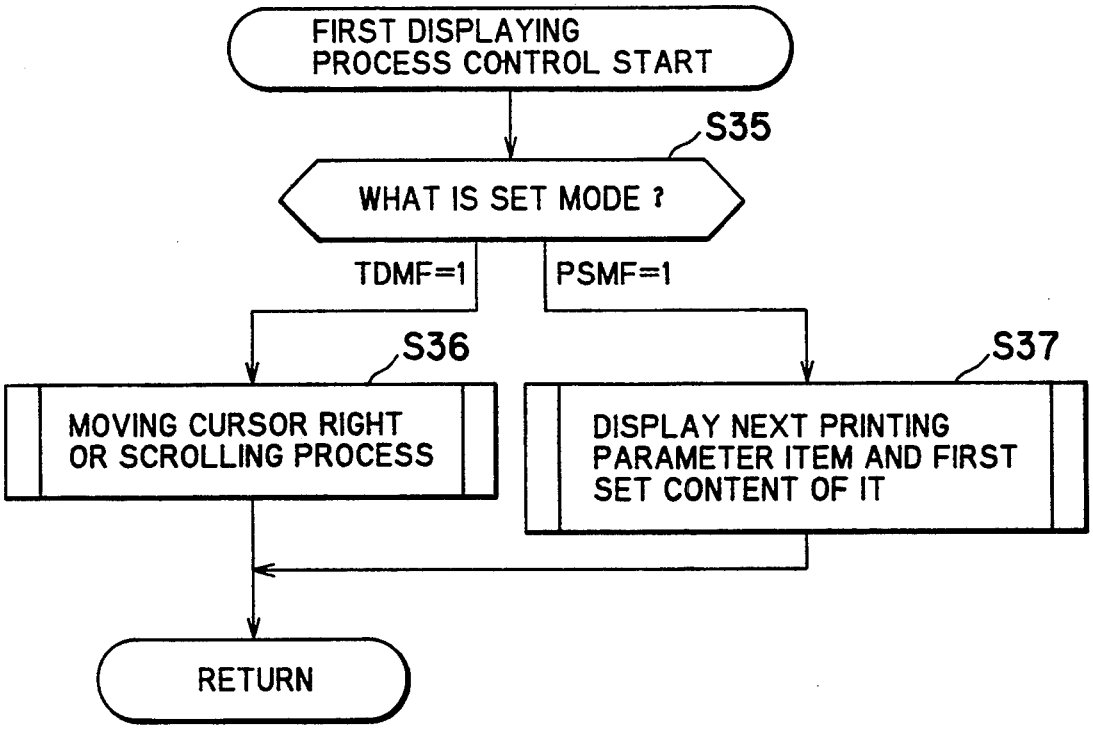
FIG. 6 is a flowchart showing a sub-routine of a first displaying process control.
Figure 7:
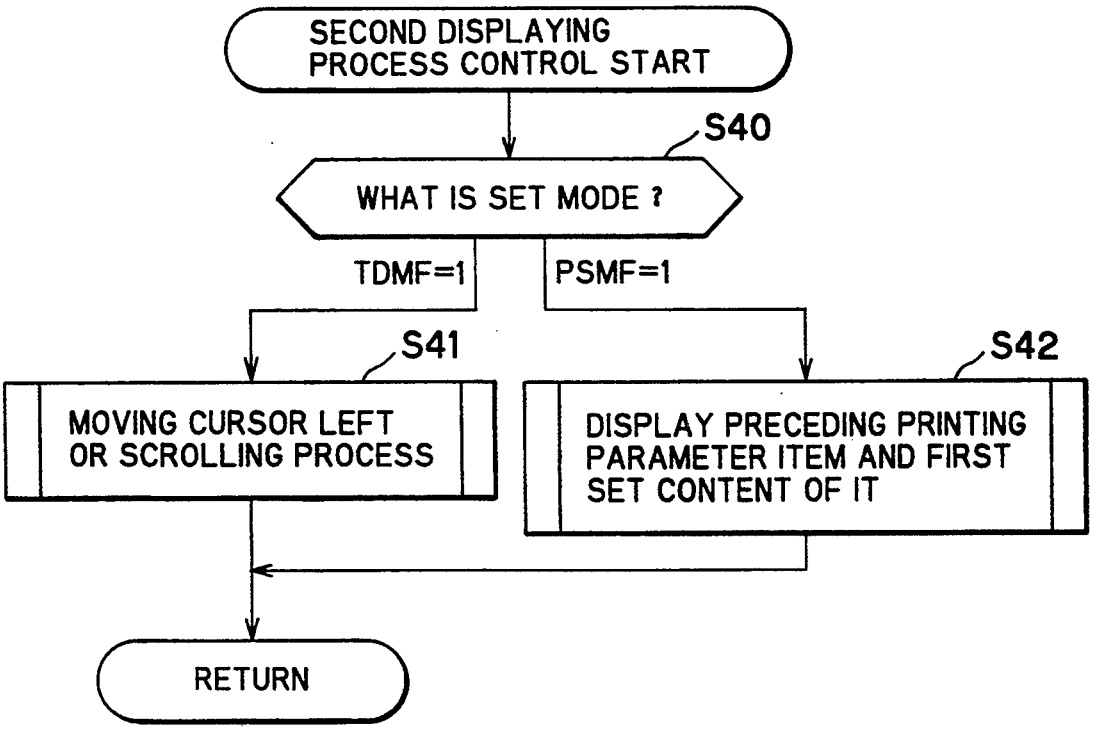
FIG. 7 is a flowchart showing a sub-routine of a second displaying process control.

A tape feed mechanism is provided including a tape feed motor 47 FIG. 4) and a tape supply mechanism driven by the tape feed motor 47. When electrical current is applied to the heat generating elements of the thermal head 15 while the press roller 14 and the takeup spool 11 are driven in their predetermined rotating direction in synchronism with each other by way of the tape supply mechanism upon rotation of the tape feed motor 47 in its predetermined rotating direction, characters or codes are printed on the laminate film tape 7 with plural trains of dots. Further, the laminate film tape 7 is superposed with the double coated tape 12 as the integral print tape 19, and the print tape 19 is fed in the tape feeding direction A (see FIG. 2) to be discharged to the outside of the body frame 2. Incidentally, the printing mechanism PM of the present embodiment is described in detail in a Japanese Patent Application Kokai No. Hei 2-106555.

Figure 2:
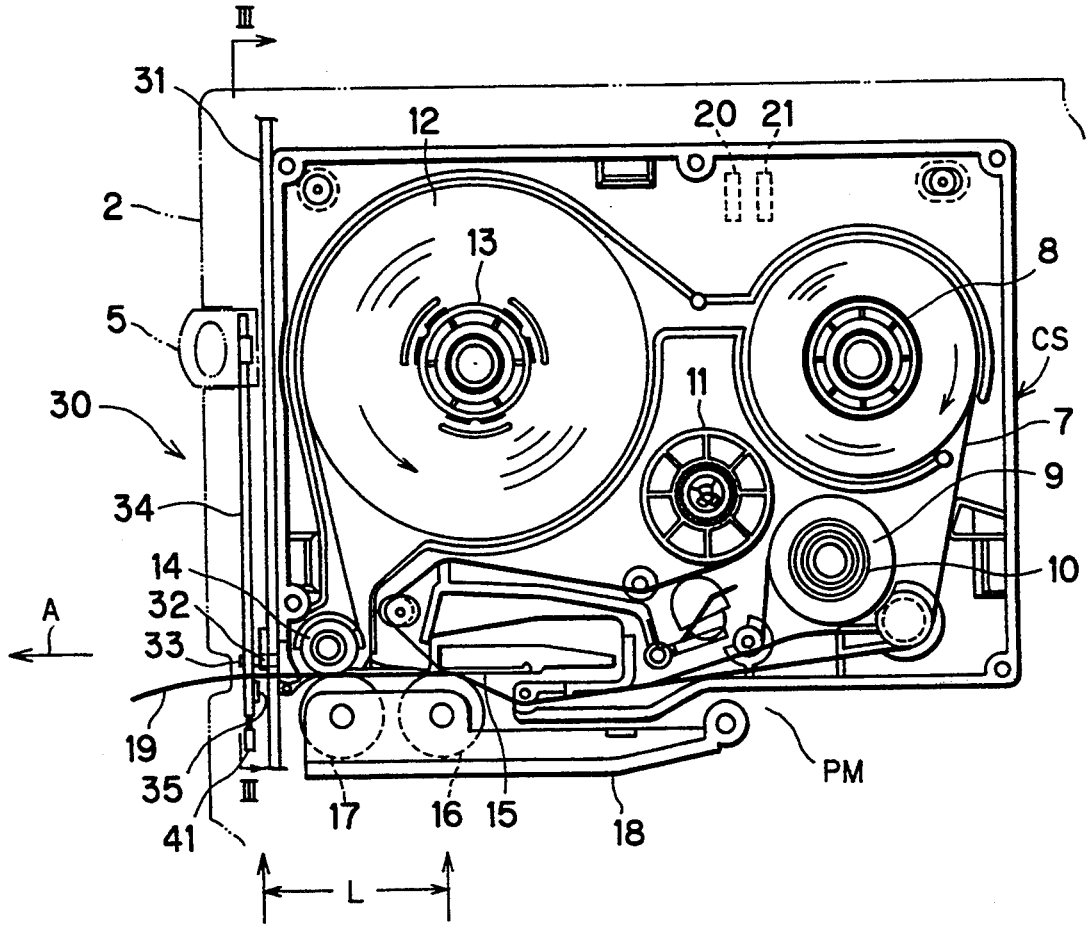
FIG. 2 is a schematic plan view showing a printing mechanism with a tape cassette loaded therein.
Figure 3:
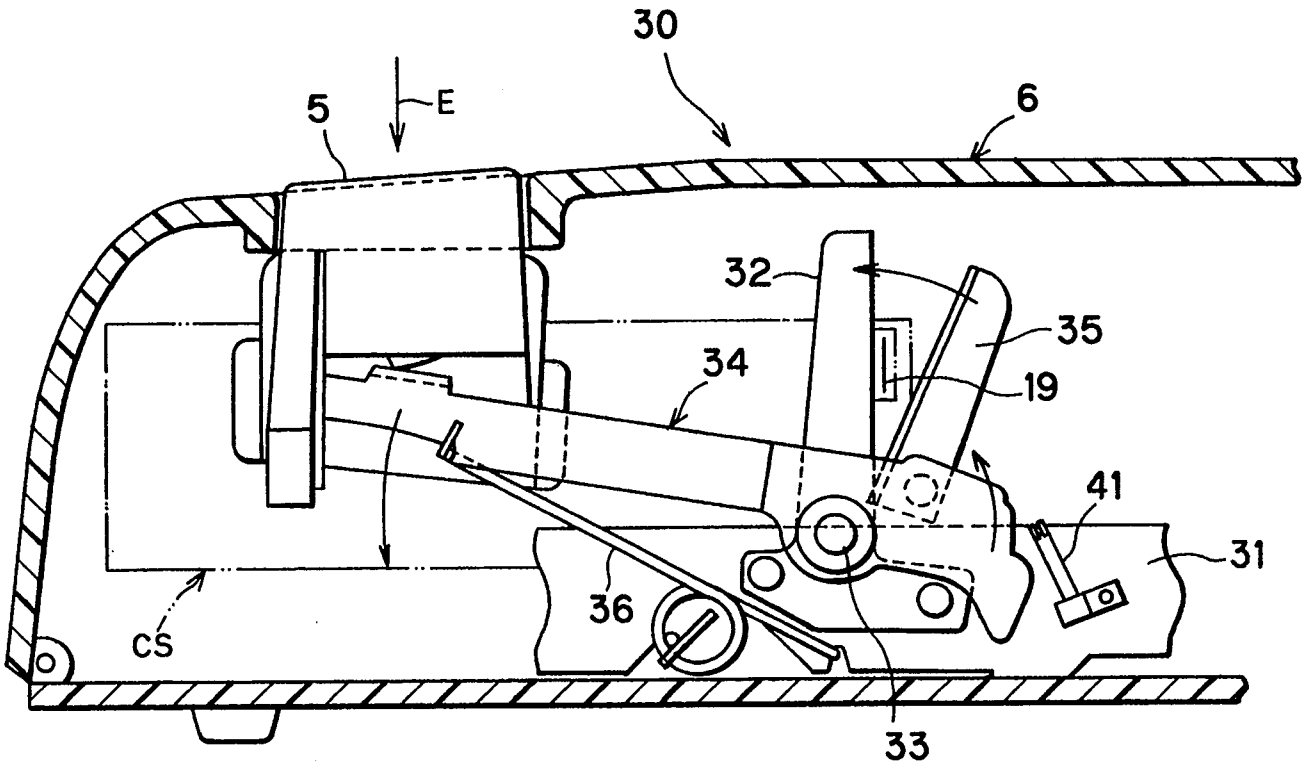
FIG. 3 is a longitudinal cross-sectional view taken along the line III—III in FIG. 2 for description of a manual cutting mechanism.

A manual cutting device 30 for cutting the print tape 19 will be described briefly with reference to FIGS. 2 and 3. Inside the body frame 2, there is provided a plate-like auxiliary frame 31 disposed in upright position, and an upwardly extending stationary blade 32 is fixedly secured to the auxiliary frame 31. A pivot shaft 33 extends horizontally in the lateral direction from the auxiliary frame 31, and a front end portion of an operation lever 34 is rotatably supported on the pivot shaft 33. The operation lever 34 extends in a forward/rearward direction. A movable blade 35 is fixed to a front portion of the operating lever 34 in such a manner that the movable blade 35 opposes the stationary blade 32. A torsion spring 36 is interposed between the operation lever 34 and the auxiliary frame 31 so as to normally urge the movable blade 35 to move away way from the stationary blade 32. The operating lever 34 has a rear end portion positioned below the cutting operation button 5. Further, a cut switch 41 such as a microswitch is attached to the front end of the operating lever 34 for detecting the angular rotation of the operating lever 34 when cutting the tape 19 by depressing the cutting operation button 5. As shown in FIG. 2, the cutting position CP of the manual cutting device 30 is about 25 mm downstream in the tape feed direction "A" of the printing position PP defined by the thermal head 15. The distance between the two positions will hereinafter be referred to as "print-to-cut distance L".

The print tape 19 delivered from the tape cassette CS and printed with characters etc. by the thermal head 15 passes through a space defined between the stationary blade 32 and the movable blade 35 and is fed out of the body frame 2. If the cutting control button 5 is pressed down (in the direction indicated by an arrow E in FIG. 3), the movable blade 35 approaches the stationary blade 32 by the movement of the operating lever 34 in a counter-clockwise direction in FIG. 3 against the biasing force of the torsion spring 36. Thus print tape 19 is cut by these blades 32 and 35.

One of the various kinds of tape cassettes can be selectively installed in the cassette installing portion of the body frame 2. For example, width of the print tape 19, color of the laminate film tape 7, and color of the ink ribbon 9 can be changed in respect of the tape cassettes. The tape width variation are, for example, 6 mm, 9 mm, 12 mm, 18 mm, and 24 mm.

The tape cassette CS has a bottom wall provided with a first set of projections 20 including three projections indicative of the width of the print tape and a second set of projections 21 including five projections indicative of a color combination of the ink ribbon 9 and the laminate film tape 7. Further, on the body frame 2 there are provided as shown in FIG. 4 a tape-width sensor 43 for detecting the tape width by the detection of the projection mode of the first set of projects 20 and a tape-color sensor 44 for detecting the combination of the colors of the laminate film tape 7 and print ribbon 9 by the detection of projecting mode of the second set of projections 21. Further, a cassette switch 42 (FIG. 4) is provided on the body frame 2 for detecting the cassette CS loaded therein.

A control system of the tape printing apparatus 1 is shown in the block diagram of FIG. 4. An input/output interface 50 of a controller C is connected with the key board 3, the cut switch 41, the cassette switch 42, the tape-width sensor 43, the tape-color sensor 44, a display controller (LCDC) 23 having a video RAM 24 for outputting display data to the liquid crystal display (LCD) 22, a driver circuit 46 for an alarming buzzer 45, a driver circuit 48 for driving the thermal head 15, and a driver circuit 49 for driving the tape feed motor 47. The cut switch 41 is adapted to output a high level cut signal SS when a cutting operation by the cutting operation button 5 is not performed and to output a low level cut signal SS during the period from the start to end of a cutting operation. The controller C includes a CPU 52 connected to the input/output interface 50. The controller C also includes a CGROM 53, ROMs 54 and 55, and a RAM 60 those connected to the CPU 52 by way of a bus 51 such as a data bus. The RAM 60 includes region of a text memory 61, a tape feed counter 62, a tape cut position memory 63, a margin counter 64, a print buffer 65, and a flag memory 66.

The CGROM 53 stores dot pattern data corresponding to code data for displaying each of a plurality of characters. The ROM 54 is a dot pattern data memory which stores dot pattern data for printing the characters, such as alphabetic characters and symbols, for each of the plurality of characters, correspondingly to the code data. The dot pattern data are classified into each of the typefaces (such as Gothic type and Ming type), and there are provided seven printed character sizes (16, 24, 32, 48, 64, 96, and 128 dot sizes) for each typeface.

The ROM 55 stores a display drive control program for controlling the display controller 23 in response to the code data of characters such as the characters and numeric characters input from the keyboard 3. The ROM 55 also stores a printing drive control program by which data from the print buffer 65 are sequentially fetched for driving the thermal head 15 and the tape feed motor 47. The ROM 55 further stores a control program for controlling the tape printing described later.

In the text memory 61 of the RAM 60, document data input from the keyboard 3 is stored. In a tape feed counter 62, the feed amount of the print tape 19 supplied after the start of the printing is stored as the tape feed count value TC in units of dots.

In the cut position memory 63, are stored as cut position data CD, a plurality of tape feed count values TC for cutting the print tape 19 when the tape cut position coincides with the cutting position CP (see FIG. 2). Is stored in the margin counter 64 a blank space amount data YC corresponding to a set blank space amount. In the print buffer 65, dot pattern data for printing a plurality of characters and symbols are stored as print data. In the flag memory 66, are stored flag data for a document input mode flag TDMF to be set when a document input mode is set (the data: "1") and another flag data for a printing parameter setting mode flag PSMF to be set when a printing parameter setting mode is established.

As items for which the printing parameters are to be set, are provided a blank space amount setting item YMF for setting blank space amount at the top and bottom of document data, a number of printed sheets setting item CMF, a numbering value setting item IMF for setting the maximum count out value for numbering, a stop at cut-position setting item SMF for setting whether the tape feed is stopped at a cut position, and a print density setting item DMF for setting the print density.

The setting items to be displayed on the display 22 are selectively displayed in the positive sequence order of YMF, CMF, IMF, SMF, and DMF by operations of the cursor-move-right key and selectively displayed in the reverse sequence order by operations of the cursor-move-left key.

Further, each setting item contains several contents. For example, as the set contents of the blank space amount setting item YMF, are provided four contents: "FULL" corresponding to the print-to-cut distance L (FIG.2), "MEDIUM" corresponding to about half the print-to-cut distance L, "NARROW" corresponding to about the two-thirds of "MEDIUM", and "NONE" providing no blank space amount.

A plurality of the set contents provided for each setting item are selectively displayed in the positive sequence order by the operations of the cursor-move-down key and they are selectively displayed in the reverse sequence by the operations of the cursor-move-up key. For example, in case of the contents of the item YMF, by operating the move-cursor-down key, "NONE", "NARROW", "MEDIUM", "FULL" are selectively displayed in the positive sequence. By operating the cursor-move-up key, they are selectively displayed in the reverse sequence.

A tape printing control routine executed in the controller C of the tape printing apparatus 1 will be described with reference to flowcharts of FIGS. 5 through 13. In this control, either the input mode in which a document is input, or the printing parameter setting mode in which various parameters for document printing are set has already been established.

When power is turned ON by the power key, the control is started. First, in step S10, initial setting is made by clearing each of the memories 61 through 66 of the RAM 60 and setting the document input mode flag TDMF. Then, a screen for inputting document data is displayed on the display 22 in S11.

Then, when a printable key such as an alphabetic character key, symbol key, and numeric character key is operated (S12, S13: Yes), if the document input mode flag TDMF has been set indicating that the mode set is the document input mode (S20: Yes), are executed, in step S21, a document data input process to store the code data of the operated key as document data into the text memory 61 of the RAM 60 and a display process to display the character corresponding to the code data on the display 22, and the control returns back to S12. However, if the set mode is not the document input mode, but the printing parameter setting mode when a printable key is operated, the determination in the step S20 falls No, the routine goes into step S22 where the alarm sound is generated by alarming buzzer 45 and an error message is displayed on the display 22, and the control returns back to S12.

Then, when the cursor-move-right key is operated (S12: Yes, S13: No, S14: Yes), a first displaying process control will be executed in S23 as shown in a flowchart of FIG. 6. When this control is started, in S35 determination is made as to whether the document input mode (flag TDMF=1) has been established. If this is the case, the cursor is moved to the display position one digit right or, a scrolling process to shift the document data one digit toward the left is performed when the rightward movement of the cursor is impossible in S36. Thereafter, this subroutine process is ended and returns to S12 of the main tape printing control.

Then, when the cursor-move-left key is operated (S12: Yes, S13 and S14: No, S15: Yes), a second display processing control will be executed in S24 as shown in a flowchart of FIG. 7. When the control is started, in S40 determination is made as to whether the document input mode (flag TDMF=1) has been established. If this is the case, the cursor is moved to the display position one digit left or, a scrolling process to shift the document data one digit toward the right is performed when the leftward movement of the cursor is impossible. Thereafter, this subroutine is ended and returns back to S12 of the main routine.

When the inputting of document data has been completed without manipulation to the cursor-move-up key nor cursor-move-down key, and the mode switch key has been operated in order to set printing parameters (S12: Yes, S13–S17: No, S18: Yes), a set mode switching process control will be executed in S27 as shown in a flowchart of FIG. 10.

When this subroutine is started, if the document input mode (flag TDMF=1) has been set (S53), the document input mode flag TDMF is reset and the printing parameter setting mode flag PSMF is set to establish the printing parameter setting mode in S54. Then, the blank space amount setting item YMF at the top is displayed and also the first set content "NONE" is displayed on the display 22 in S55, and the control ends and returns to S12.

If the printing parameter setting mode flag (flag PSMF=1) has been set (S53) when the subroutine is started, the printing parameter setting mode flag PSMF is reset and the document input mode flag TDMF is set to establish the document input mode in S56, and the document data in the text memory 61 is displayed on the display 22 in S57. Then, the routine returns back to S12.

If the cursor-move-right key is operated when the printing parameter setting mode has been established (S12: Yes, S13: No, S14: Yes), the first display processing control (FIG. 6) is executed in S23 as described above. In this first display processing control, the printing parameter setting mode (flag PSMF=1) has been established, so that as a result of the determination in S35, the routine proceeds into step S37 where displayed on the display 22 are setting item following the setting item currently displayed and the first set content of the setting item. Then the control returns to S12.

On the other hand, if the cursor-move-left key is operated (S12: Yes, S13 and S14: No, S15: Yes), the second display processing control is executed in S24 as described above with reference to FIG. 7. When this control is started, if the printing parameter setting mode (flag PSMF=1) has been established (S40), the setting item preceding the currently displayed setting item and the first set content of the setting item are displayed on the display 22 in step S42, and the control returns to S12.

Figure 8:
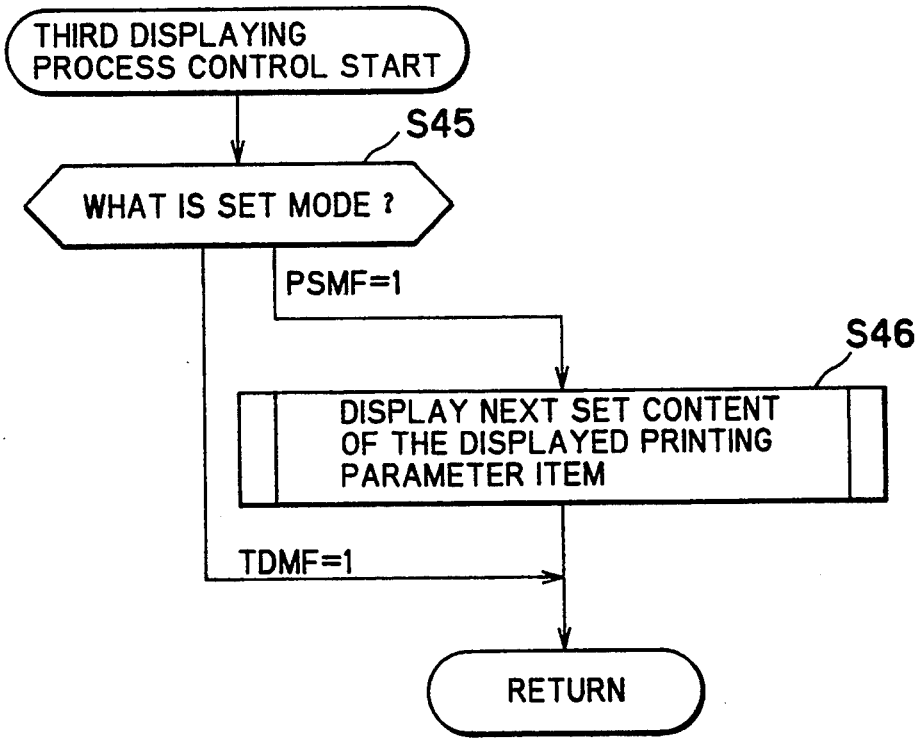
FIG. 8 is a flowchart showing a sub-routine of a third displaying process control.

If the cursor-move-down key is operated (S12: Yes, S13–S15: No, S16: Yes), a third display processing control shown in FIG. 8 is executed in S25. When the control is started, if the printing parameter setting mode (flag PSMF =1) has been established (S45), the set content following the set content of the printing parameter setting item currently displayed is displayed on the display 22 in S46, and the control is ended and returns to S12. If the document input mode (flag TDMF=1) has been set (S45) when the control is started, the control is terminated immediately and returns to S12.

Figure 9:
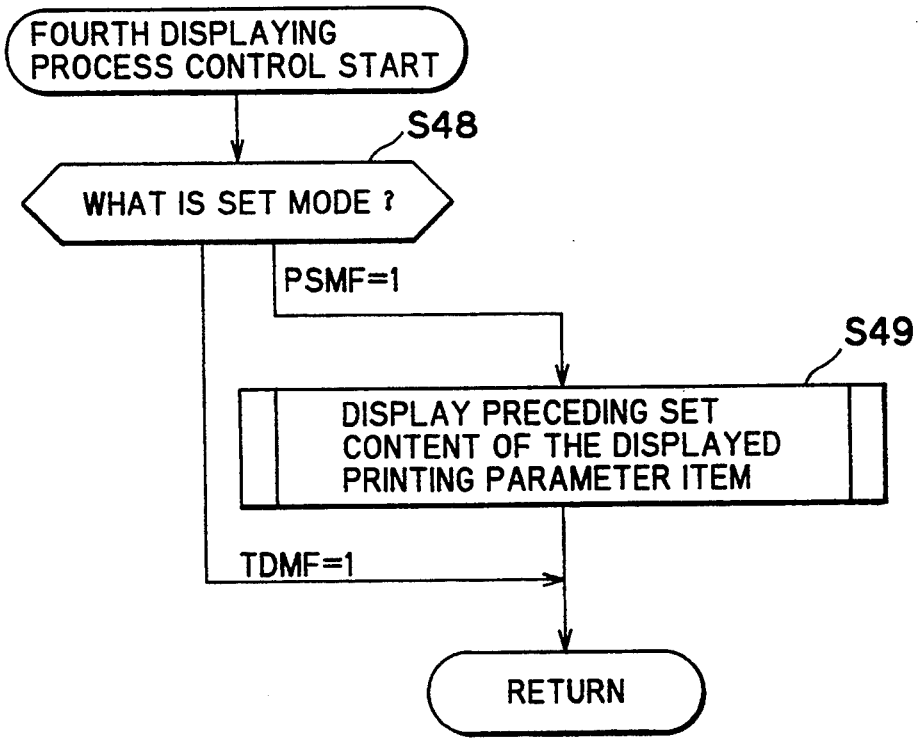
FIG. 9 is a flowchart showing a sub-routine of a fourth displaying process control.
Figure 10:
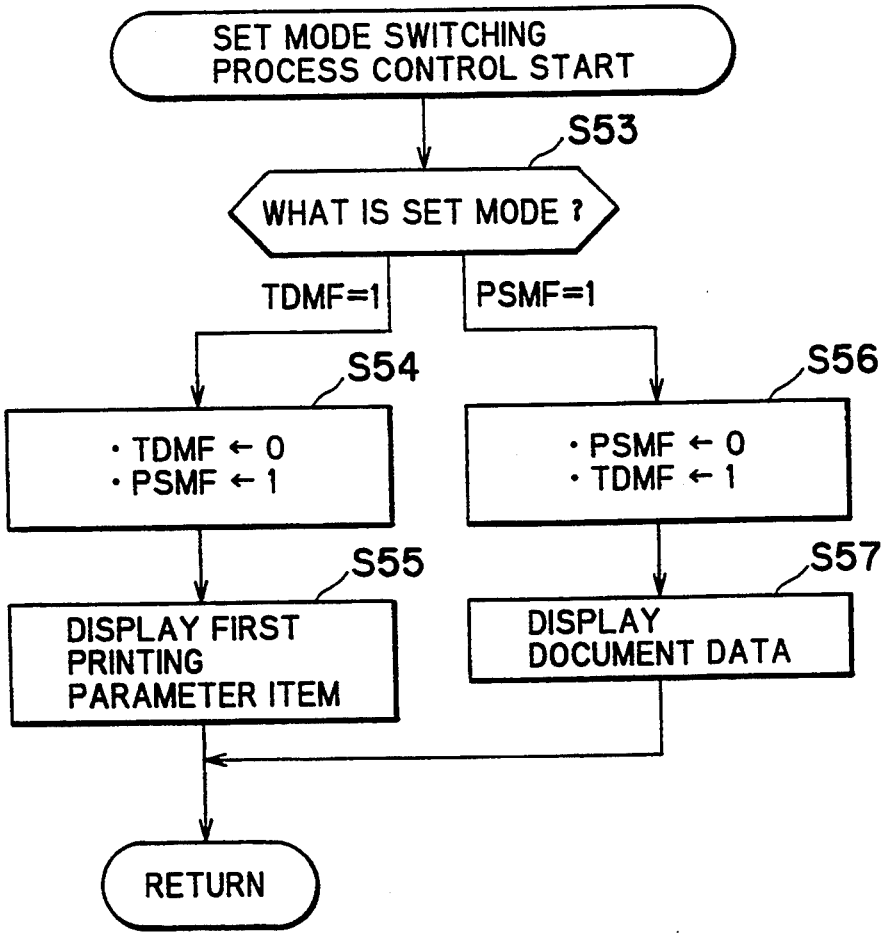
FIG. 10 is a flowchart showing a sub-routine of set mode switching process control.

If the cursor-move-up key is operated (S12: Yes, S13–S16: No, S17: Yes), a fourth display processing control is executed in S26 as shown in FIG. 9. When the control is started, if the printing parameter setting mode (flag PSMF=1) has been established (S48), the set content preceding the set content of the printing parameter setting item currently displayed is displayed on the display 22 in S49, and the control is terminated and returns to S12. If the document input mode (flag TDMF=1) has been set (S48) when the control is started, the control is terminated immediately and returns to S12.

Figure 11:
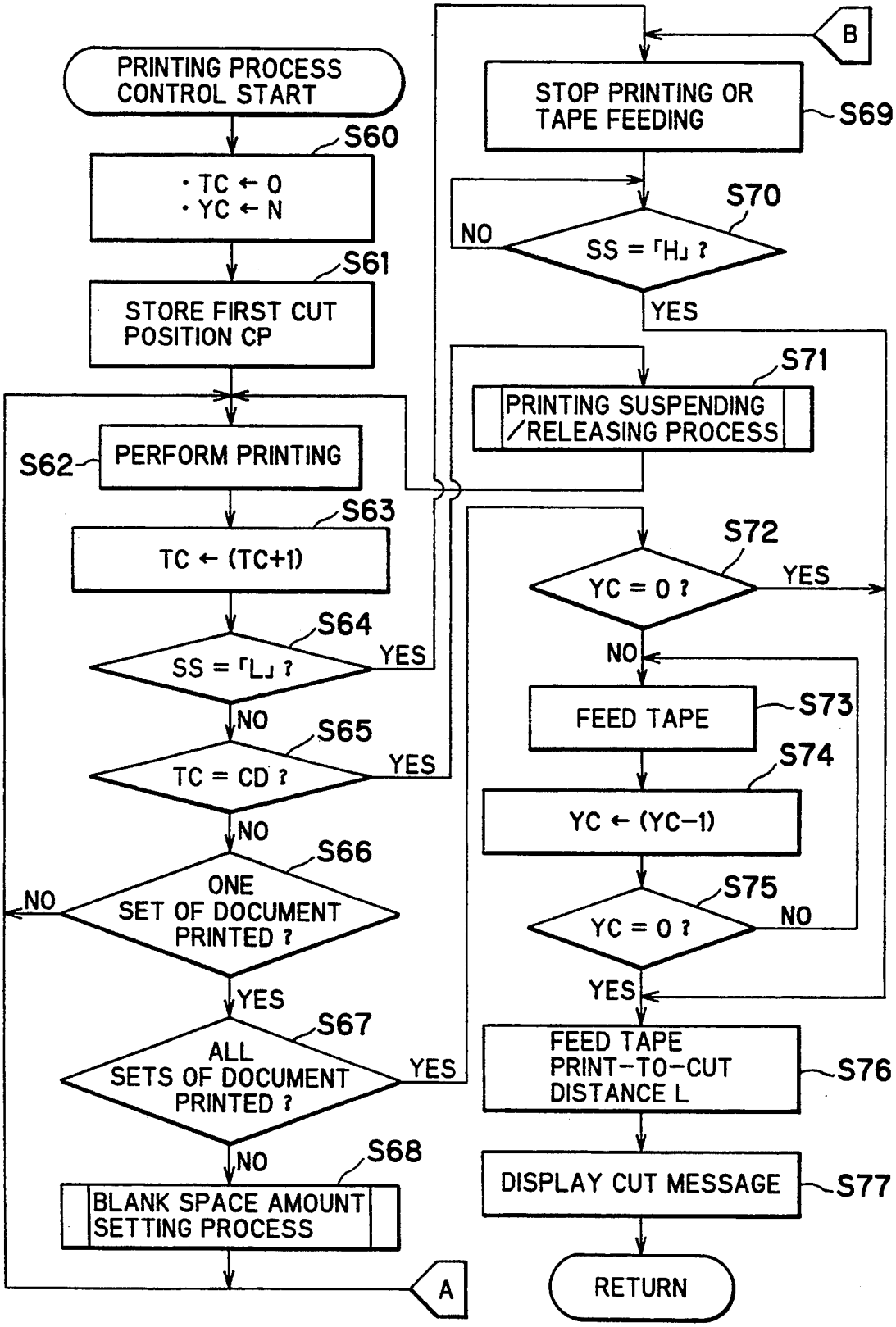
FIG. 11 is a flowchart showing a routine of printing process control.

Next, when the print key is operated in order to print input document data (S12: Yes, S13–S18: No, S19: Yes), if the printing parameter setting mode (flag PSMF=1) has been established (S28: Yes), the printing process control is executed in S29 as shown in FIG. 11. However, when the document input mode (flag TDMF=1) has been established (S28: No), the control returns to S12. At this time, apart from the printing process control, a process for reading the dot pattern data with respect to characters and symbols of the document data and a process for developing plural sets of documents onto the print buffer 65 in accordance with set contents of the number-of-printed-sheets setting item CMF and the numbering value setting item IMF of the printing parameter setting items are executed in a dot pattern data generating process control. However, description of the latter control is negligible.

When the printing process control is started, the tape feed count value TC in the tape feed counter 62 is cleared, and the blank space amount N, corresponding to the set content ("NONE," "NARROW," "MEDIUM," or "FULL") of the blank space amount setting item is set in the form of dot numbers as the blank space amount data YC in the blank space amount counter 64 in S60. Further, in step S61, is computed the tape feed count value TC of the top cut position CP where the top margin space amount provided on the forward side of the starting point of the printing is cut in a case other than a case where the set content of the blank space amount setting item is "FULL," on the basis of the data of the print-to-cut distance L and the data of the set content of the blank space amount setting item, and the computed value is stored into the cut position memory 63 as the cut position data CD.

Then, printing of one train of dots read from the print buffer 65 is performed in S62, and the tape feed count value TC in the tape feed counter 62 is incremented by one dot in S63. The printing operation includes the printing process for printing one train of dots performed by the thermal head 15 and the tape feeding process for feeding the print tape 19 by one dot. If the cut signal SS transmitted from the cut switch 41 is "H" indicating the cutting operation by the cutting control button 5 is not being performed (S64: No), and if the tape feed count value TC has not yet been coincident with the cut position data CD stored in the cut position memory 63, i.e., the intended cut position on the print tape 19 has not yet reached the cutting position CP of the manual cutting device 30 (S65: No), and, further if a series of printing processes of the document data in the text memory 61 is not completed, i.e., printing of one set of the document is not completed (S66: No), the control returns to S62 and the processes following S62 will be repeatedly performed.

Figure 12:
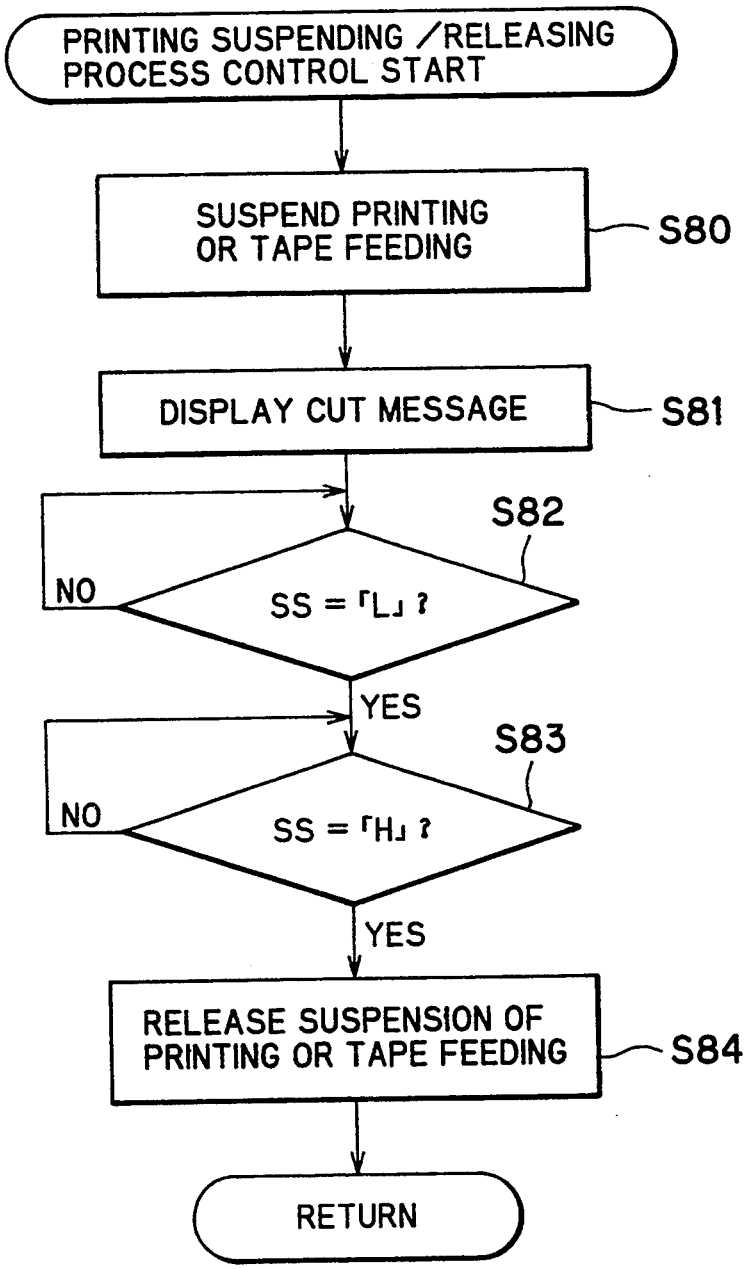
FIG. 12 is a flowchart showing a sub-routine of print suspending and suspension releasing process control in the printing process control of FIG. 11.

When the tape feed count value TC becomes coincident with the cut position data CD stored in the cut position memory 63 after the repetition of the printing operations (S65: Yes), a print suspending and releasing process will be performed in S71 as shown in FIG. 12.

When this print suspending and releasing process is started, the printing or tape feeding operation in progress is suspended in S80 and a cut message, such as "CUT THE TAPE," is displayed on the display 22 in S81. Then, the cutting operation by means of the cutting operation button 5 is started. In this case, by manually depressing the cutting operation button 5, the cut switch 41 is switched to output low level signal SS (S82: Yes). When the cutting operation has been completed (S83: Yes), the suspension of the printing or tape feeding operation is released in S84, and the control returns to S62 of the printing process control. Then, the processes following S62 are performed and thus the printing operation or tape feeding, that has been suspended, is again carried out.

Figure 14:
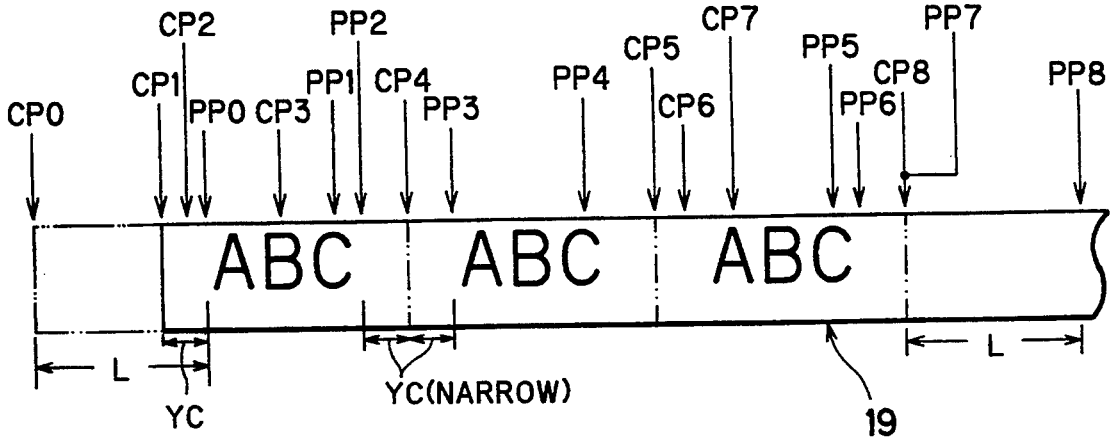
FIG. 14 is a schematic plan view showing a print tape for description of printing positions and cutting positions when a blank space amount "NARROW" has been set and plural sets of documents are to be printed.

For example, when, as shown in FIG. 14, "NARROW" is set as the set content of the blank space amount setting item YMF, the printing operation of the document data "ABC" is performed in units of trains of dots from the print starting position indicated by PP0, The cutting position is indicated by CP0, and the leading edge of the tape is positioned at CP0. In this case, a first cutting position CP1 is defined, which is distant from the print starting position PP0 by the length of "NARROW" to provide a top blank amount or top margin. Then, when first cutting position CP1 reaches the cut position CP0, the printing operation is suspended and the cutting operation of the print tape 19 is performed and, thereafter, the suspended printing operation is resumed to be continued.

Figure 13:
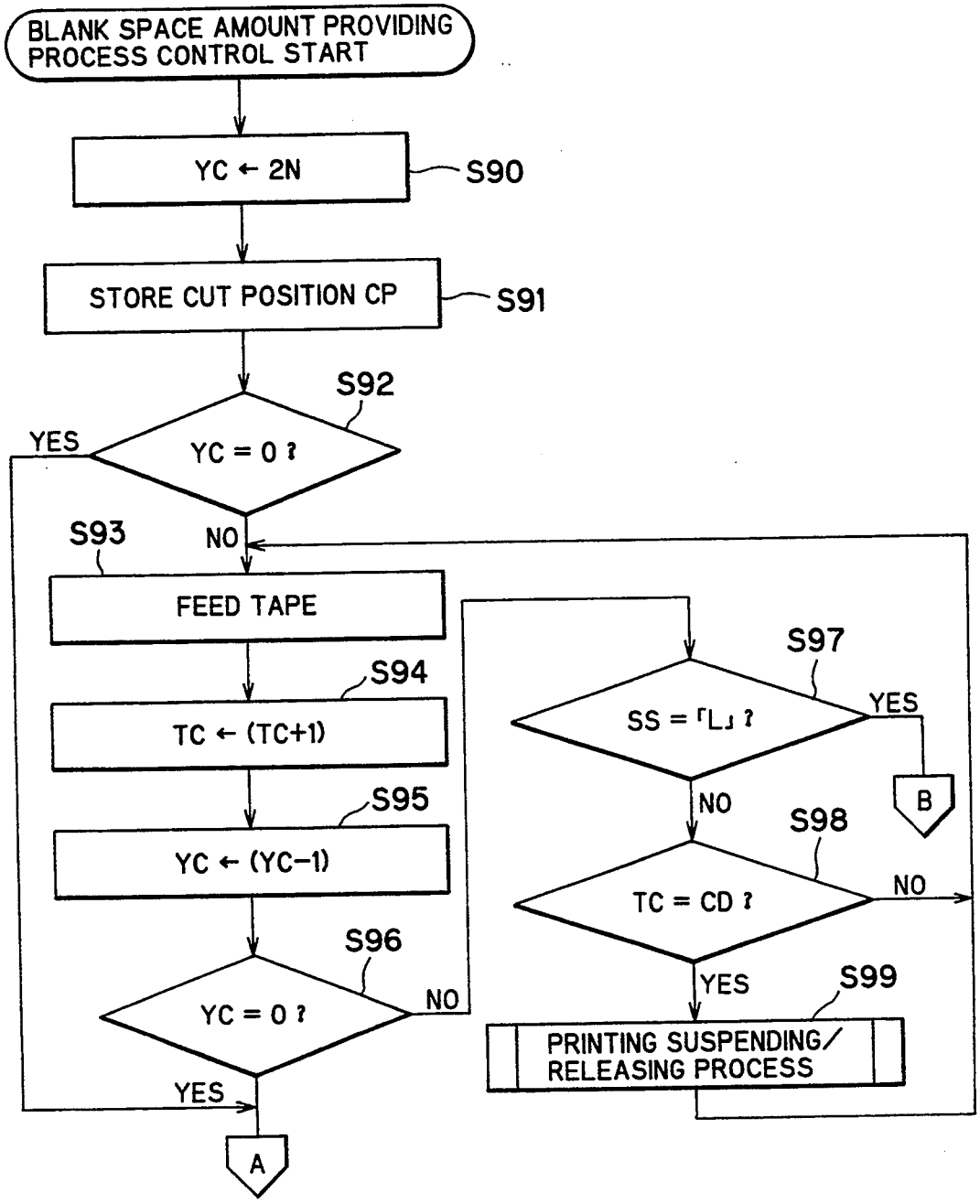
FIG. 13 is a flowchart showing a sub-routine of blank space amount providing process control in the printing process control of FIG. 11.

Assuming that a plurality of identical documents to be printed have been set according to the setting of the "number of printed sheets" for the number-of-printed-sheets setting item CMF, when the printing of one set of the document has been completed (S66: Yes) but printing of subsequent sets of the documents has not yet been completed, the determination in step S67 falls No, so that the routine goes into step S68 for executing a blank space amount providing process control for providing the set blank space amount between neighboring documents as shown in FIG. 13.

When this control is started, double the set blank space amount N is set as the blank space amount data YC (S90). The "double" space implies a rear margin of a precedent document plus a top margin of a subsequent document. Then in step S91, is computed the tape feed count value TC of the cut position CP by adding the number of dots of the blank space amount N to the number of dots corresponding to the print-to-cut distance L, and the computed value is stored into the cut position memory 63 as the cut position data CD. When the set content of the blank space amount N is not "NONE", and therefore, the blank space amount data YC is not 0 (S92: No), the tape is fed one dot (S93), and the tape feed count value TC is incremented by 1 dot (S94), and further, the blank space amount data YC is decremented by 1 dot (S95).

When the blank space amount data YC is not 0 (S96: No), if the cut signal SS is "H" indicating that the cutting operation by means of the cutting operation button 5 is not being performed (S97: No) and, further, the tape feed count value TC has not yet reached the cut position data CD (S98: No), the processes following the step S93 are repeatedly performed. When the tape feed count value TC becomes coincident with the cut position data CD (S98: Yes), the printing suspending and suspension/releasing process is executed (S99) in order to cut the printing tape 19, and thereafter, the processes following the step S93 are performed. When the blank space amount data YC has become 0 (S96: Yes), the control is terminated and returns to S62 of the main printing process control.

For example, as shown in FIG. 14, the tape is fed by a length of twice as large as the blank space amount "NARROW" from the printing position PP2 to the printing position PP3, and meanwhile, is stored as the cut position data CD into the cut position memory 63, the tape feed count value TC with respect to the subsequent cut position CP computed by adding the number of dots corresponding to the print-to-cut distance L to the number of dots corresponding to the bottom margin amount or bottom blank space amount "NARROW", so that the last document can be cut after being fed by the distance L plus a length of the rear margin.

In the printing process control shown in FIG. 11, when printing to all sets of the documents has been completed (S66, S67: Yes), the rear blank space for the document of the final set is provided by storing dot numbers corresponding to the final rear blank space, and tape feeding is performed to the final cut position in steps S72 through S77. More specifically, when the set content of the blank space amount is not "NONE" and the blank space amount data YC is not 0 (S72: No), tape feeding by one dot is performed (S73), and the tape feed count value TC is incremented by 1 dot (S74), and further, the tape feed count value TC is decremented by 1 dot (S75). When the blank space amount data YC is not 0 (S75: No), S73–S75 are repeatedly performed, and when the blank space amount data YC becomes 0 (S75: Yes), tape is fed by a predetermined numbers of dots corresponding to the print-to-cut distance L in S76. After the tape feeding is stopped, tape cut message is displayed on the display 22 (S77). Then, this control is terminated and the routine returns to S12 of the tape printing control described above.

For example, as shown in FIG. 14, cutting is performed at the boundary between neighboring sets of documents when the cutting position coincides with CP4 and CP5, and printing of all sets of the documents is completed when the printing position coincides with PP6. Then, tape feeding is performed until the printing position becomes coincident with PP7. Thus, the rear blank space amount "NARROW" can be provided following the last document "ABC." Further, tape feeding corresponding to the predetermined amount of dots which correspond to the print-to-cut distance L is performed, and when the printing position is coincident with PP8, the print tape 19 is cut at the cut position CP8.

Figure 15:
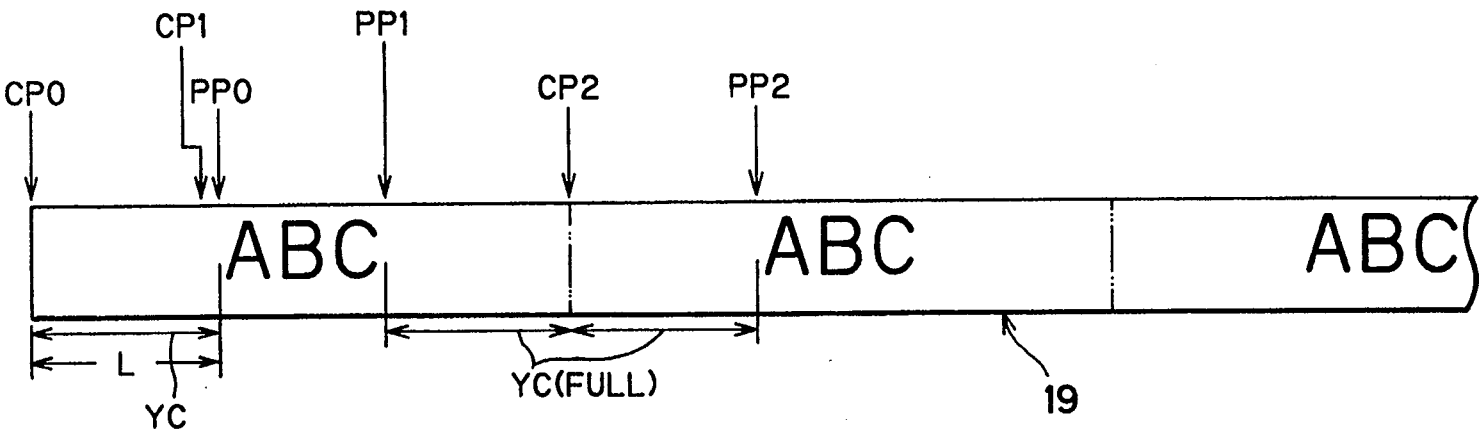
FIG. 15 is a schematic plan view corresponding to FIG. 14 when a blank space amount "FULL" has been set and plural sets of documents are to be printed.

On the other hand, "FULL" is set as the set content of the blank space amount setting item YMF, printing operation of the document data "ABC" is performed in units of trains of dots from the printing starting position where the cutting position is coincident with CP0 and the printing position is coincident with PP0, as shown in FIG. 15. Then, when the bottom blank amount "FULL" and the following top blank space amount are provided from the printing position PP1 to the printing position PP2, i.e., when the cutting position is coincident with CP2, the printing operation is suspended and the print tape 19 is cut. Having similar operations repeated, printing of all sets of the documents is carried out, with providing the blank space amounts "FULL" in the meantime.

Figure 16:
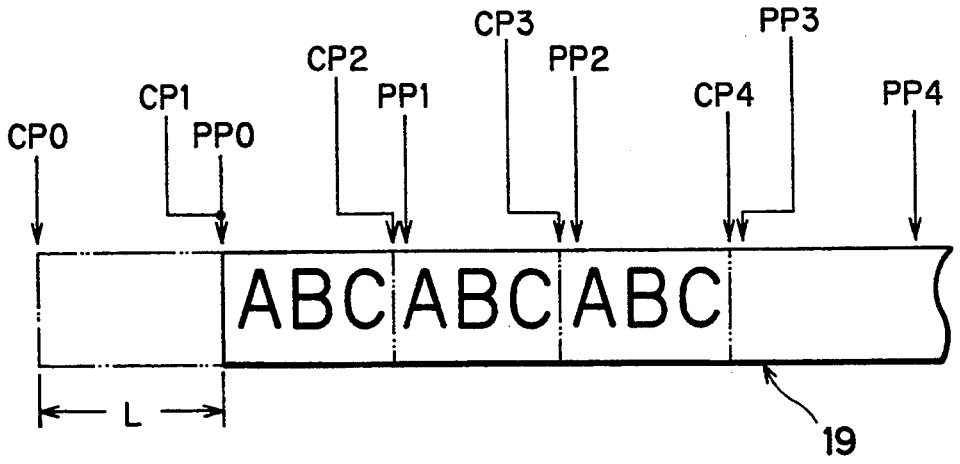
FIG. 16 is a schematic plan view corresponding to FIG. 14 when a blank space amount "NONE" has been set and plural sets of documents are to be printed.

Further, when, for example, "NONE" is set as the set content of the blank space amount setting item YMF, printing operation of the document data "ABC" is performed in units of trains of dots from the printing starting position, where the cutting position is coincident with CP0 and the printing position is coincident with PP0, as shown in FIG. 16. When printing operation for the number of dots corresponding to the print-to-cut distance L is performed, i.e., when the cutting position is coincident with CP1, the printing operation is suspended and the print tape 19 is cut. Thereafter, at the cutting positions CP2 and CP3 where the respective set of the documents have been printed, the printing is suspended and the print tape 19 is cut similarly to the above. After the last set of the document has been printed and the tape is fed by the predetermined amount corresponding to the print-to-cut distance L, the print tape 19 is cut when the printing position becomes coincident with PP4 and the cutting position is brought into coincidence with CP4.

In the printing process control, the operator may inadvertently operates the cutting operation button 5 while printing operation is being performed in S62–S67. Due to this erroneous operation, the cut signal SS from the cut switch 41 becomes low level (S64: Yes), so that the printing or tape feeding operation is stopped (S69). Then, when the cutting operation has been completed and the cut signal SS from the cut switch 41 becomes "H" (S70), tape is fed by the predetermined amount corresponding to the print-to-cut distance L in S76. After the end of the tape feeding, the tape feeding is stopped and the cut message is displayed on the display 22 (S77), and then the control is ended and returns to S12 of the main tape printing control.

Figure 17:
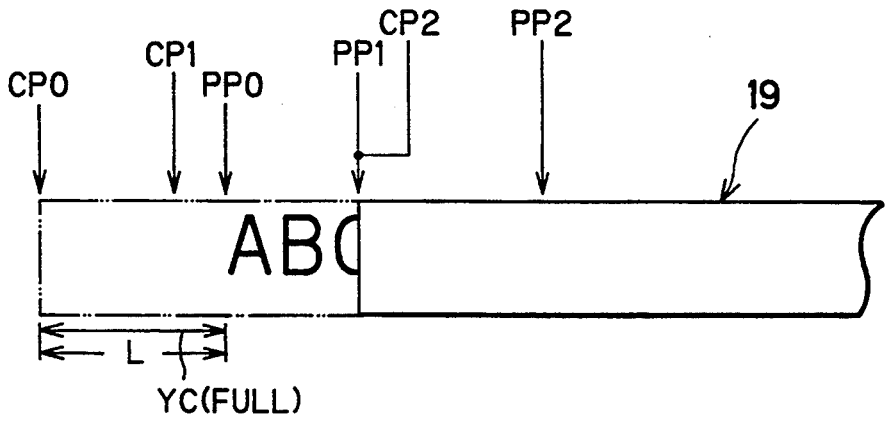
FIG. 17 is a schematic plan view showing a print tape for description of printing positions and cutting positions when a cutting operation is made while the tape is being printed.

For example, provided that "FULL" has been set as the set content of the blank space amount setting item and document data "ABC" is being printed from the printing position PP0 as shown in FIG. 17, if the operator erroneously operates the cutting operation button 5 to make a cutting operation while the character "C" is being printed, i.e., when the printing position is at PP1, the printing operation is immediately stopped. Accordingly, even if the print tape 19 is caught by the stationary blade 32 and movable blade 35 in the cutting operation so that the print tape 19 becomes unable to be discharged to the outside, entanglement of the print tape 19 with the driving system at the outlet of the tape cassette CS can be prevented, since the print tape feeding is immediately stopped after manipulation to the cut operation button 5.

Further, tape is fed by the predetermined amount corresponding to the print-to-cut distance L upon completion of the cutting operation, the printing position and the cutting position can be automatically shifted to PP2 and CP2, respectively. and the print tape 19 is cut at the CP2 position. More specifically, the print tape 19 is fed by the predetermined amount corresponding to the print-to-cut distance L from the position where the printing operation was stopped and the tape is cut with the manual cutting device 30. Accordingly previously printed area does not remain in the print tape area between the printing position PP and the cut position CP of the manual cutting device 30. Thus, a fresh area of the print tape where no printed image by the previous printing operation remains can be automatically provided without a particular tape feeding operation, to thus facilitate printing operation. In other words, sufficient top margin can be provided with respect to the subsequent printing. If such automatic tape feeding is not performed, insufficient margin may be provided between cut image provided by the previous inadvertent operation to the tape cut operation button 5 and a new leading end image provided in the subsequent printing.

Also in the blank space amount providing process, if the operator erroneously operates the cutting operation button 5 to cut the tape while tape feeding is being performed through S92–S98, the cut signal SS from the cut switch 41 becomes "L" (S97: Yes) and then, the tape feeding operation which has been performed in S69–S70 and S76–S77 is stopped. Therefore, similarly to the above, the print tape 19 does not become entangled with the driving system in the vicinity of the outlet of the tape cassette CS and accordingly, breakdown of the tape cassette CS is avoidable. Incidentally, the cut switch 41 serves as cut operation detection means, and the printing process control, especially S69–S76 serves as print stopping means.

While the invention has been described in detail with reference to the specific embodiment thereof, it would be apparent to those skilled in the art that various changes and modifications may be made therein without departing from the spirit and scope of the invention. For example, the invention can be applied to various tape printing apparatuses having a manual cutting device and capable of printing documents of Western languages such as Germany and French on a tape-like printing medium. Further, in the above depicted embodiment, various switches or sensors such as a photo-interrupter and a proximity switch can be used as the cut switch 41, and the cut switch can be disposed in any other position as long as it can detect the start and end of the tape cutting operation.

What is claimed is:

1. A tape printing apparatus for printing an image on a tape medium, the apparatus comprising:

printing means having a tape feed mechanism for feeding the tape medium, and a printing head for printing the image on the tape medium during a printing operation;

a manual cutting device having a cutting mechanism for cutting the tape medium;

cutting operation detection means for detecting a start of the cutting operation of the manual cutting device, a cutting operation start signal being generated upon detection of the start of the cutting operation; and means for stopping the printing operation to the tape medium in response to the cutting operation start signal.

2. The tape printing apparatus as claimed in claim 1, wherein the tape feed mechanism has means for feeding the tape medium in a tape feeding direction, and wherein the manual cutting device is disposed downstream of the printing head in the tape feeding direction.

3. The tape printing apparatus as claimed in claim 2, further comprising control means for controlling the tape feed mechanism and the printing head of the printing means, the means for stopping the printing operation generating, in response to the cutting operation start switch, a print stopping signal which is transmittable to the control means for rendering the printing means inoperative.

4. The tape printing apparatus as claimed in claim 3, wherein the tape medium is accommodated in a tape cassette, and the apparatus further comprising a body frame for installing the tape cassette.

5. The tape printing apparatus as claimed in claim 4, wherein the manual cutting device further comprises a cutting control member for starting cutting operation to the tape medium printed by the printing head and fed by the tape feed mechanism.

6. The tape printing apparatus as claimed in claim 5, wherein the manual cutting device comprises:

a stationary blade fixed to one side of the body frame;

an operation lever pivotally movably supported to the body frame;

a movable blade fixed to the operation lever, a pivotal movement of the operation lever moving the movable blade toward and away from the stationary blade;

the cutting control member being engageable with the operation lever.

7. The tape printing apparatus as claimed in claim 6, wherein the manual cutting device further comprises a biasing means for biasing the operation lever in a first direction so that the movable blade is moved away from the stationary blade, the cutting control member moving the operation lever in a second direction opposite the first direction against a biasing force of the biasing means.

8. The tape printing apparatus as claimed in claim 5, wherein the cutting operation detection means comprises a microswitch which detects angular rotation of the operating lever.

9. The tape printing apparatus as claimed in claim 5, wherein the cutting operation detection means comprises a photo-interrupter which detects movement of the manual cutting device.

10. The tape printing apparatus as claimed in claim 5, wherein the cutting operation detection means comprises a proximity switch which detects movement of the manual cutting device.

11. The tape printing apparatus as claimed in claim 5, wherein the printing head has heat generating elements arrayed in line for providing an array of dots for forming the image on the tape medium, and the apparatus further comprising:

a tape feed counter in which is stored a count value incremented by formation of the dot array upon start of the printing operation;

a margin setting means for providing a length of a margin to be provided between neighboring documents;

a margin counter in which is stored margin data corresponding to the margin set by the margin setting means; and means for suspending the printing operation when the count value in the tape feed counter is coincident with the margin data in the margin counter.

12. The tape printing apparatus as claimed in claim 3, wherein the cutting operation detection means further comprises means for detecting an end phase of the cutting operation, a cutting operation end signal being generated upon detection of the end of the cutting operation; and the apparatus further comprising:

means for starting operation of the tape feed mechanism so as to feed the tape medium by a predetermined length, the starting means generating, in response to the cutting operation end signal, a tape feed start signal which is transmittable to the control means for rendering the tape feed mechanism operative.

13. The tape printing apparatus as claimed in claim 12, wherein the manual cutting device provides a cutting position, and the printing head provides a printing position, the predetermined length being a distance between the cutting position and the printing position.

14. A tape printing apparatus for printing an image in a tape medium accommodated in a tape cassette. the apparatus comprising:

a body frame in which the tape cassette is installable;

printing means having a tape feed mechanism for feeding the tape medium in a tape feeding direction, and a printing head for printing characters and symbols on the tape medium fed by the tape feed mechanism;

control means for controlling the tape feed mechanism and the printing head of the printing means;

a manual cutting device disposed downstream of the printing head in the tape feeding direction, the manual cutting device having a cutting mechanism;

cutting operation detection means for detecting a start of the cutting operation of the manual cutting device, a cutting operation start signal being generated upon detection of the start of the cutting operation; and means for stopping printing operation for stopping a printing operation to the tape medium, the stopping means generating, in response to the cutting operation start signal, a print stopping signal which is transmitted to the control means to render the printing means inoperative.

15. The tape printing apparatus as claimed in claim 14, wherein the manual cutting device further comprises a cutting control member for starting cutting operation to the tape medium printed by the printing head and fed by the tape feed mechanism.

16. The tape printing apparatus as claimed in claim 15, wherein the cutting operation detection means further comprises means for detecting an end phase of the cutting operation, a cutting operation end signal being generated upon detection of the end of the cutting operation; and the apparatus further comprising:

means for starting operation of the tape feed mechanism so as to feed the tape medium by a predetermined length, the starting means generating, in response to the cutting operation end signal, a tape feed start signal which is transmittable to the control means for rendering the tape feed mechanism operative.

17. A method for printing an image on a tape medium with using a tape printing apparatus comprising printing means having a tape feed mechanism for feeding the tape medium and a printing head for printing the image on the tape medium during a printing operation, and a manual cutting device for cutting the tape medium, the method comprising the steps of:

detecting operation of the manual cutting device; and stopping the printing operation of the printing means in response to the detection.

18. The method as claimed in claim 17, further comprising the steps of:

storing a cutting position on the tape medium;

first judging detection of the operation of the manual cutting device;

second judging whether or not the cutting position reaches the manual cutting device;

third judging whether or not an entire printing to a set of a document has been completed; and repeating the first through third judging steps if the manal cutting device has not been operated, and if the cutting position is not coincident with the manual cutting device, and if an entire printing to a set of document has not yet been completed.

19. The method as claimed in claim 18, further comprising the steps of feeding the tape medium by a length after a terminal edge portion of the image of a last set of document is printed, the length being a length of a rear margin plus a distance between the printing head and the manual cutting device.

* * * * *